US011798451B2

(12) United States Patent
Ha et al.

(10) Patent No.: US 11,798,451 B2
(45) Date of Patent: Oct. 24, 2023

(54) DISPLAY APPARATUS AND DATA PROCESSING METHOD THEREOF

(71) Applicant: LG Display Co., Ltd., Seoul (KR)

(72) Inventors: Sung Chul Ha, Gumi-si (KR); Hyun Chul Kim, Seoul (KR); Mi So Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/856,755

(22) Filed: Jul. 1, 2022

(65) Prior Publication Data

US 2023/0005405 A1 Jan. 5, 2023

(30) Foreign Application Priority Data

Jul. 2, 2021 (KR) ..... 10-2021-0086961

(51) Int. Cl.
*G09G 3/20* (2006.01)

(52) U.S. Cl.
CPC ..... *G09G 3/20* (2013.01); *G09G 2330/021* (2013.01); *G09G 2330/06* (2013.01)

(58) Field of Classification Search
CPC ..... G09G 3/20; G09G 2330/021; G09G 2330/06; G09G 2310/0264–0297
See application file for complete search history.

(56) References Cited

U.S. PATENT DOCUMENTS

2002/0140686 A1* 10/2002 Noguchi ..... G09G 3/3688 345/204
2005/0052439 A1* 3/2005 Liou ..... G09G 3/20 345/204
2006/0120202 A1* 6/2006 Kim ..... G09G 3/20 365/230.06
2006/0125757 A1* 6/2006 Kang ..... G09G 3/3666 345/98
2011/0149047 A1* 6/2011 Min ..... G09G 3/3666 348/51

* cited by examiner

*Primary Examiner* — Stephen G Sherman
(74) *Attorney, Agent, or Firm* — Seed IP Law Group LLP

(57) ABSTRACT

A display apparatus includes a display panel including a first surface including first pixels and a second surface including second pixels, the first surface contacting the second surface at a panel center thereof, a first source integrated circuit (IC) sequentially latching first image data, which is to be applied to the first surface, in a first direction facing the panel center at a panel edge of the first surface, and a second source IC sequentially latching second image data, which is to be applied to the second surface, in a second direction facing the panel center at a panel edge of the second surface, wherein the first direction is opposite to the second direction.

27 Claims, 18 Drawing Sheets

DISPLAY APPARATUS AND DATA PROCESSING METHOD THEREOF

CROSS-REFERENCE TO RELATED APPLICATIONS

This application claims the benefit of the Korean Patent Application No. 10-2021-0086961 filed on Jul. 2, 2021, which is hereby incorporated by reference as if fully set forth herein.

BACKGROUND

Technical Field

The present disclosure relates to a display apparatus and a data processing method thereof.

DESCRIPTION OF THE RELATED ART

As a resolution and a size of display apparatuses increase, the amount of digital data transferred from a timing controller to a source integrated circuit so as to display an image is increasing. As the amount of transferred data increases, display apparatuses of the related art have a problem where electromagnetic interface (EMI) and power consumption increase.

BRIEF SUMMARY

To overcome the various technical problems in the related art as well as the aforementioned problem identified by the inventors, the present disclosure may provide a display apparatus and a data processing method thereof, which decrease a bandwidth of data transferred between a timing controller and a source integrated circuit to reduce or minimize EMI and power consumption.

To achieve these technical benefits and other advantages and in accordance with the purpose of the disclosure, as embodied and broadly described herein, a display apparatus includes a display panel including a first surface including first pixels and a second surface including second pixels, the first surface contacting the second surface at a panel center thereof, a first source integrated circuit (IC) sequentially latching first image data, which is to be applied to the first surface, in a first direction facing the panel center at a panel edge of the first surface, and a second source IC sequentially latching second image data, which is to be applied to the second surface, in a second direction facing the panel center at a panel edge of the second surface, wherein the first direction is opposite to the second direction.

In another aspect of the present disclosure, a data processing method of a display apparatus, including a display panel including a first surface including first pixels and a second surface including second pixels, the first surface contacting the second surface at a panel center thereof, includes sequentially latching first image data, which is to be applied to the first surface, in a first direction facing the panel center at a panel edge of the first surface and sequentially latching second image data, which is to be applied to the second surface, in a second direction facing the panel center at a panel edge of the second surface, wherein the first direction is opposite to the second direction.

BRIEF DESCRIPTION OF THE SEVERAL VIEWS OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Figure 1:
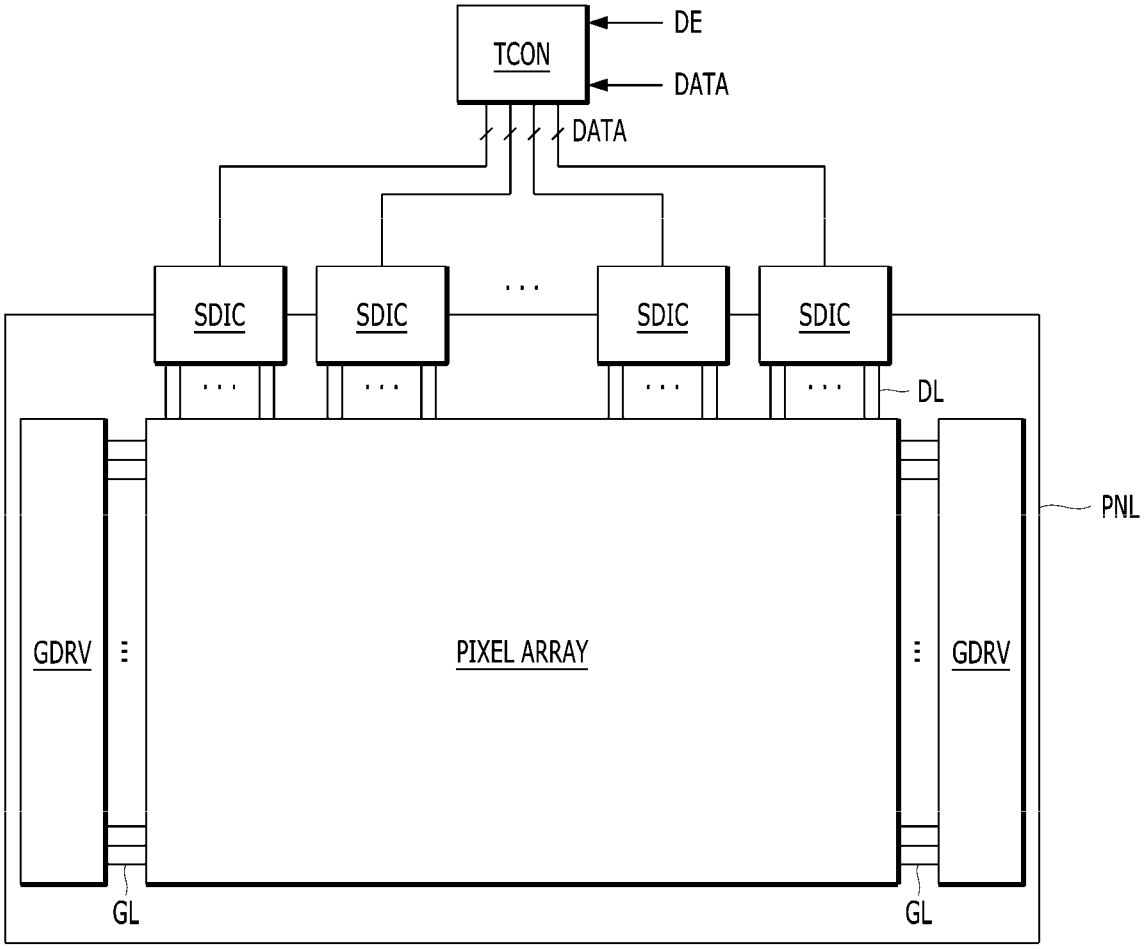
FIG. 1 is a diagram illustrating a display apparatus according to an embodiment of the present disclosure.

Hereinafter, the present disclosure will be described more fully with reference to the accompanying drawings, in which example embodiments of the disclosure are shown. The disclosure may, however, be embodied in many different forms and should not be construed as being limited to the embodiments set forth herein; rather, these embodiments are provided so that this disclosure will be thorough and complete, and will fully convey the concept of the disclosure to those skilled in the art.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art.

The shapes, sizes, ratios, angles, numbers and the like disclosed in the drawings for description of various embodiments of the present disclosure to describe embodiments of the present disclosure are merely examples and the present disclosure is not limited thereto. Like reference numerals refer to like elements throughout. Throughout this specification, the same elements are denoted by the same reference numerals. As used herein, the terms "comprise," "having," "including" and the like suggest that other parts can be added unless the term "only" is used. As used herein, the singular forms "a," "an," and "the" are intended to include the plural forms as well, unless context clearly indicates otherwise.

Elements in various embodiments of the present disclosure are to be interpreted as including margins of error even without explicit statements.

In describing a position relationship, for example, when a position relation between two parts is described as "on~," "over~," "under~," and "next~," one or more other parts may be disposed between the two parts unless "just" or "direct" is used.

It will be understood that, although the terms "first," "second," etc., may be used herein to describe various elements, these elements should not be limited by these terms. These terms are only used to distinguish one element from another. For example, a first element could be termed a second element, and, similarly, a second element could be termed a first element, without departing from the scope of the present disclosure.

In the following description, when the detailed description of the relevant known function or configuration is determined to unnecessarily obscure the important point of the present disclosure, the detailed description will be omitted. Hereinafter, embodiments of the present disclosure will be described in detail with reference to the accompanying drawings.

Figure 2:
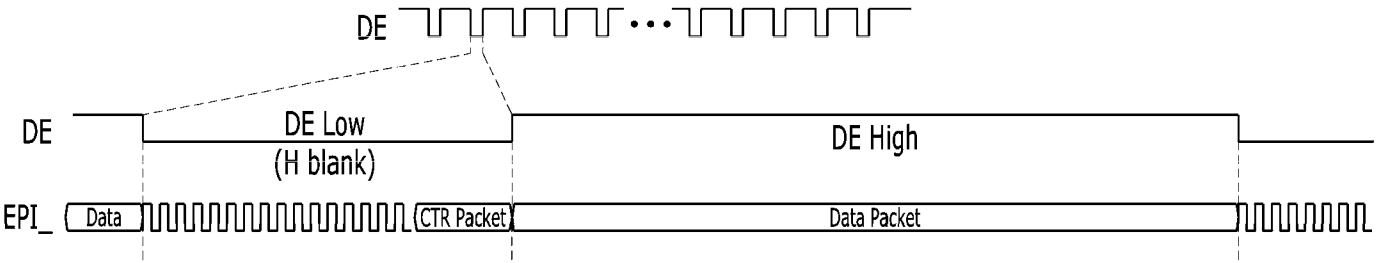
FIG. 2 is a diagram illustrating a data transfer format between a timing controller and a source integrated circuit (IC) in the display apparatus of FIG. 1.

FIG. 1 is a diagram illustrating a display apparatus according to an embodiment of the present disclosure. FIG. 2 is a diagram illustrating a data transfer format between a timing controller and a source integrated circuit (IC) in the display apparatus of FIG. 1.

The inventive concept may be applied to flat panel display apparatuses such as liquid crystal display (LCD) apparatuses, field emission display (FED) apparatuses, plasma display panel (PDP), organic light emitting display apparatuses, and inorganic light emitting display apparatuses, but is not limited thereto. The inventive concept may be applied to bendable display apparatuses, foldable display apparatuses, rollable display apparatuses, flexible display apparatuses, etc. Hereinafter, an organic light emitting display apparatus will be described for example, but the inventive concept is not limited to the organic light emitting display apparatus. Also, the inventive concept is not limited to the terms of elements described in claims. Various terms "circuit" described in claims is not limited to hardware and may denote "logic" performing a corresponding function.

Referring to FIG. 1, the display apparatus according to an embodiment of the present disclosure may include a display panel PNL, a timing controller TCON, a source integrated circuit (IC) SDIC, and a gate driver GDRV. The timing controller TCON and the source IC SDIC may be connected to each other through an embedded panel interface (EPI) device.

The display panel PNL may include a pixel array which displays an input image. The pixel array may include a plurality of pixels which are arranged as a matrix type based on an overlapping structure of a plurality of data lines DL and a plurality of gate lines GL. Each of the plurality of pixels may include a red (R) pixel, a green (G) pixel, and a blue (B) pixel, for implementing colors, and moreover, may further include a white (W) pixel.

Each of the subpixels may include a light emitting device, a driving element, a switching element, and a storage element. Internal compensation technology and external compensation technology may be applied for compensating for a driving characteristic deviation between subpixels in association with the light emitting device and/or the driving element. The internal compensation technology may compensate for a driving current flowing in the light emitting device by using a compensation circuit included in each subpixel, regardless of a characteristic variation of the driving element. In the external compensation technology, a sensing circuit disposed outside the display panel PNL may sense a driving characteristic variation of the light emitting device and/or the driving element of each subpixel, and a compensation circuit may correct image data which is to be applied to each subpixel, in order to compensate for the sensed driving characteristic variation.

The pixel array may further include a plurality of touch sensors, for implementing a touch user interface (UI). The touch sensors may each be implemented as a capacitive touch sensor which senses a touch input based on a variation of a capacitance before and after a touch is applied thereto, but are not limited thereto.

The timing controller TCON may receive digital image data and a timing signal, including a vertical synchronization signal, a horizontal synchronization signal, and a data enable signal, from a host system. The timing controller TCON may generate timing control signals for controlling an operation timing of the source driver SDIC and an operation timing of the gate driver GDRV based on the timing signal. The timing control signals may include a source timing control signal for controlling the operation timing of the source driver SDIC and a gate timing control signal for controlling the operation timing of the gate driver GDRV. The source timing control signal may include a source output enable signal (see SOE of FIG. 3) and a latch control signal (see LbR and DLYLR of FIG. 6).

The timing controller TCON may be connected to the source driver SDIC through a clock-embedded interface device based on a coding scheme based on a point-to-point scheme and may transfer a data transfer packet including R, G, B, and W image data DATA to the source driver SDIC. In the clock-embedded interface device, because the R, G, B, and W image data DATA and a clock are included in the data transfer packet and are transferred through one transfer line, a separate clock transfer line may be omitted in a high-resolution and large-size display apparatus and the number of transfer lines may be easily reduced. In the data transfer packet, the clock may not be synchronized with the R, G, B, and W image data DATA and may have only transition information so as to be recovered by a reception circuit, and thus, a clock-embedded type may be better than a clock-split type in terms of a transfer limitation. A clock-embedded interface device may include a transfer circuit, a transfer line, and a reception circuit, the transfer circuit may be embedded into the timing controller TCON, and the reception circuit may be embedded into the source driver SDIC.

The transfer circuit may encode scrambled clock-embedded image data and clock-embedded blank data and may transfer a data transfer packet encoded in a serial data format to the reception circuit through a plurality of transfer lines. The clock-embedded blank data may include a clock training pattern (CTP) corresponding to a blank period.

Furthermore, a 1 data transfer packet transferred to the reception circuit by the transfer circuit may further include control packet data CTR. The control packet data CTR may be allocated to the blank period. The blank period may be a logic low period of a data enable signal DE. The logic low period of the data enable signal DE may be an active period to which the clock-embedded image data is allocated. The control packet data CTR may include a gate timing control signal for controlling an operation timing of the gate driver GDRV and a source timing control signal for controlling an operation timing of the source IC SDIC. The gate timing control signal and the source timing control signal may be recovered by the reception circuit.

The source driver SDIC may recover the R, G, B, and W image data DATA and a source timing control signal SOE, LbR, and DLYLR, latch and gamma-compensate for the R, G, B, and W image data DATA based on the source timing control signal SOE, LbR, and DLYLR, and output gamma-compensated image data to the data lines DL. Data voltages output to the data lines DL may be applied to pixels in synchronization with a scan signal supplied through the gate lines GL. The source driver SDIC may recover the gate timing control signal and may supply the recovered gate timing control signal to the gate driver GDRV through a separate signal line.

The gate driver GDRV may generate the scan signal which swings between a gate-on voltage and a gate-off voltage, based on the gate timing control signal. The gate-on voltage may be a voltage for turning on a switching element of each subpixel, and the gate-off voltage may be a voltage for turning off the switching element of each subpixel. The gate driver GDRV may sequentially or non-sequentially output the scan signal to the gate lines GL to select subpixels, into which data voltages are to be charged, by horizontal line units.

The gate driver GDRV may be disposed in a non-display area outside the pixel array in the display panel PNL. The gate driver GDRV may be designed based on a double bank scheme so that an RC delay deviation at each panel position corresponding to the same scan signal is reduced or minimized. According to the double bank scheme, the gate driver GDRV may be disposed in both non-display areas with the pixel array therebetween.

Figure 3:
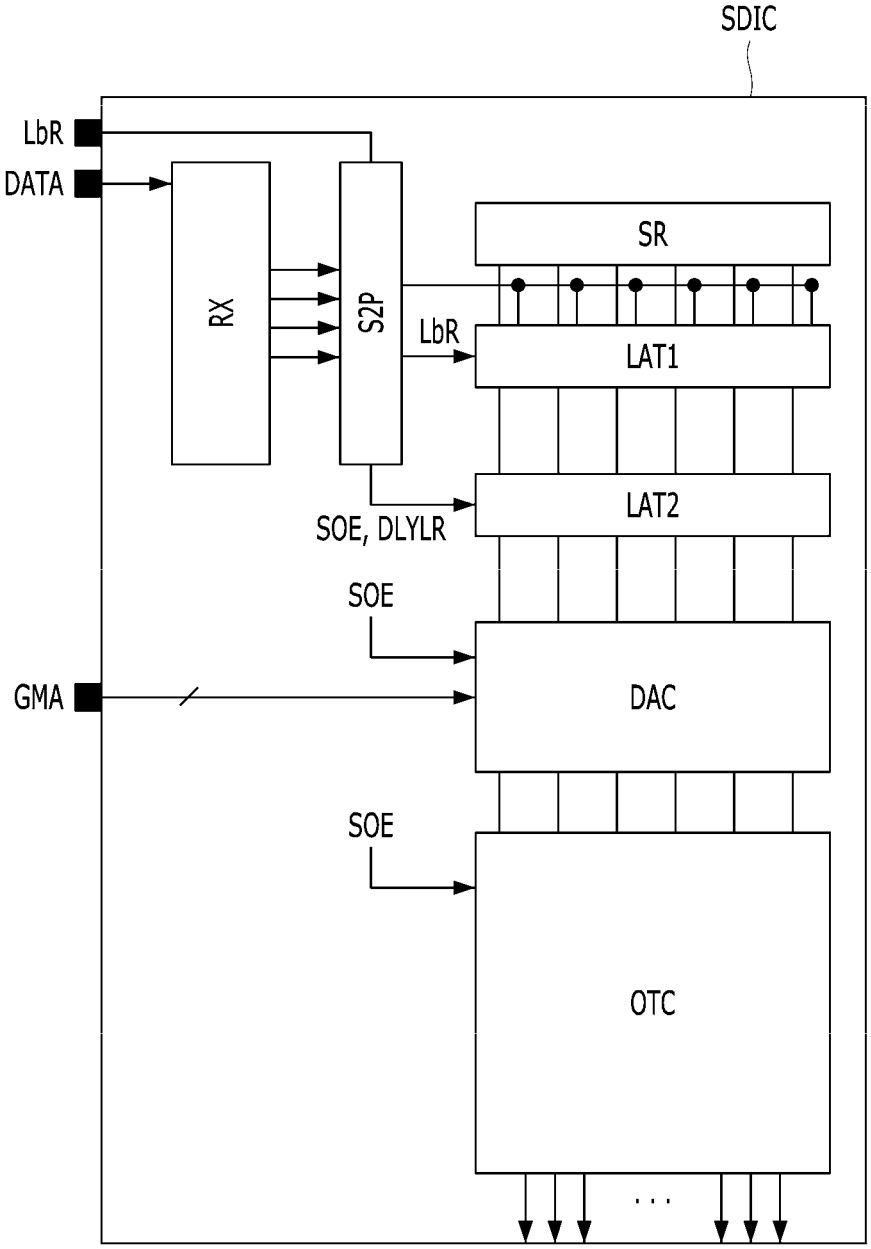
FIG. 3 is a diagram illustrating a source IC according to an embodiment of the present disclosure.
Figure 4:
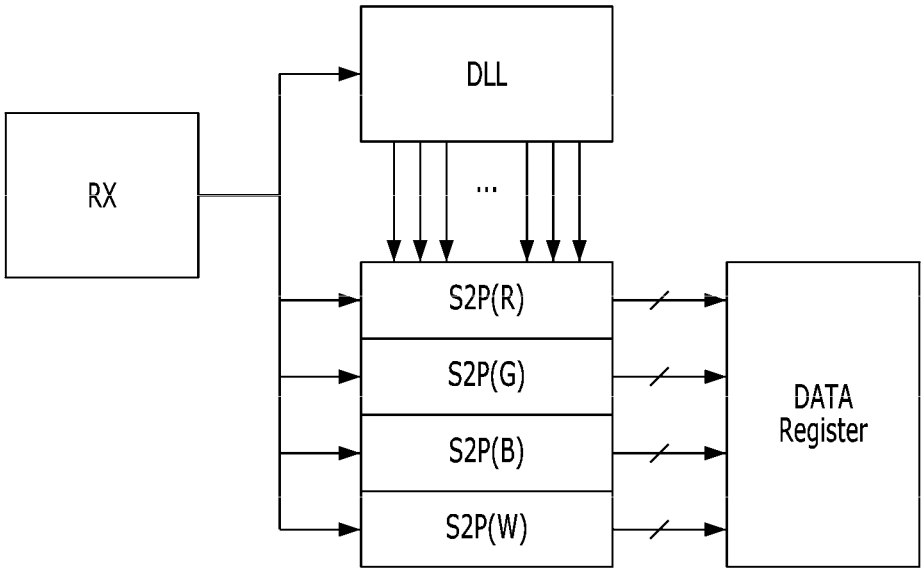
FIGS. 4 and 5 are diagrams for describing a first latch operation performed in the source IC of FIG. 2.
Figure 5:
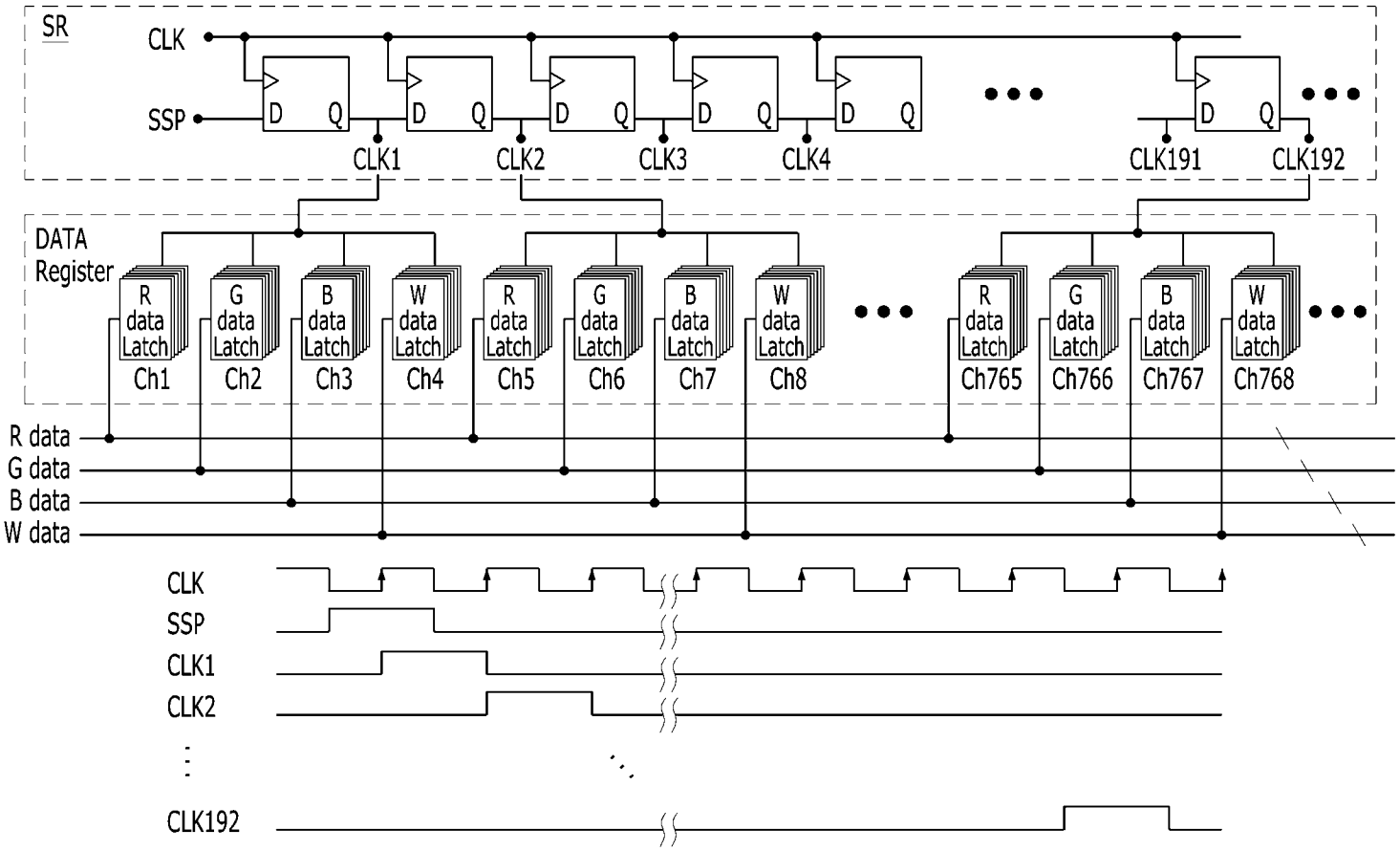

FIG. 3 is a diagram illustrating a source IC SDIC according to an embodiment of the present disclosure. FIGS. 4 and 5 are diagrams for describing a first latch operation performed in the source IC of FIG. 2.

Referring to FIGS. 3 to 5, the source IC SDIC may include a reception circuit RX, a parallelization circuit S2P, a shift register SR, a first latch circuit LAT1, a second latch circuit LAT2, a digital-to-analog converter DAC, and an output circuit OTC.

The reception circuit RX may include a clock and data recovery (CDR) circuit for recovering clock information from a data transfer packet. The CDR circuit may receive the data transfer packet through a transfer line and may track a transition pattern of the data transfer packet to recover the clock information included in the data transfer packet. Accordingly, in some embodiments, the CDR circuit may use a phase locked loop (PLL) or a delay locked loop (DLL). The reception circuit RX may decode the data transfer packet based on the clock information recovered by the CDR circuit and may descramble decoded data to recover the R, G, B, and W image data DATA and the source timing control signal SOE, LbR, and DLYLR.

The shift register SR may generate sampling reference clocks CLK1 to CLK192 based on predetermined internal clock timing signals CLK and SSP. The shift register SR may be implemented with D-flip flops, but is not limited thereto.

The parallelization circuit S2P may sample the recovered R, G, B, and W image data DATA based on the sampling reference clocks CLK1 to CLK192 and may convert each of the sampled R, G, B, and W image data DATA into a parallel data format.

The first latch circuit LAT1 may sequentially store the R, G, B, and W image data DATA converted into the parallel data format in a data register based on a first latch control signal LbR (hereinafter referred to as a first latch operation). The first latch control signal LbR may determine a direction in which the first latch operation is performed. The first latch operation may be sequentially performed in a first direction from a channel 1 to a channel 768, or may be sequentially performed in a second direction from the channel 768 to the channel 1. FIG. 5 illustrates an example where the first latch operation is performed in the first direction.

The second latch circuit LAT2 may sequentially output the R, G, B, and W image data DATA, stored in the data register, to the digital-to-analog converter DAC based on a second latch control signal DLYLR and a source output enable signal SOE (hereinafter referred to as a second latch operation). The second latch control signal DLYLR may determine a direction in which the second latch operation is performed. A direction in which the second latch operation is performed may match a direction in which an output delay amount of the digital-to-analog converter DAC increases. The second latch operation may be sequentially performed in the first direction from the channel 1 to the channel 768, or may be sequentially performed in the second direction from the channel 768 to the channel 1.

The digital-to-analog converter DAC may map the R, G, B, and W image data DATA, input from the data register, to gamma compensation voltages GMA to generate data voltages.

The output circuit OTC may include a plurality of output buffers respectively corresponding to the data lines. Each of the output buffers may be connected to a corresponding data line through a channel and may output a data voltage, which is an analog output of the digital-to-analog converter DAC, to the corresponding data line based on the source output enable signal SOE. The output buffer may output a data voltage to a data line in a logic low period of the source output enable signal SOE. Also, a connection between the output buffer and the data line may be released during the logic low period of the source output enable signal SOE.

Figure 6:
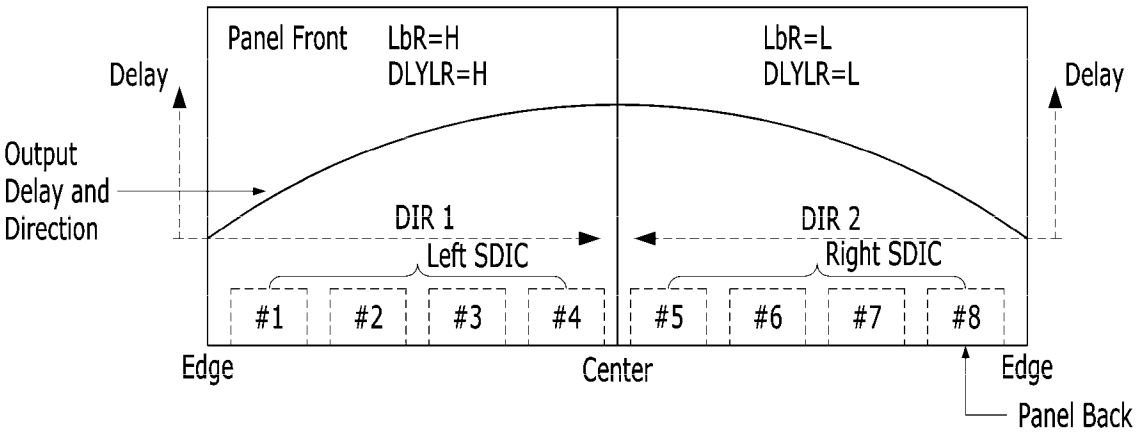
FIG. 6 is a diagram illustrating first and second ICs for surface-divisionally driving a display panel and an output delay amount and a latch direction of each of the first and second source ICs.

FIG. 6 is a diagram illustrating first and second ICs for surface-divisionally driving a display panel and an output delay amount and a latch direction of each of the first and second source ICs.

Referring to FIG. 6, the display panel may include a first surface where first pixels are provided and a second surface where second pixels are provided, and the first surface may contact the second surface at a panel center, labelled "Center" in FIG. 6. The first surface may be disposed at a left portion with respect to the panel center, Center, and the second surface may be disposed at a right portion with respect to the panel center, Center.

The first source IC and the second source IC may surface-divisionally drive the display panel. The first source IC may include a plurality of left source ICs Left SDIC which are disposed on a panel rear surface and drive a first surface, and the second source IC may include a plurality of right source ICs Right SDIC which are disposed on the panel rear surface and drive a second surface.

The first source IC may sequentially latch first image data, which is to be applied to the first surface, in a first direction DIR1 from a panel edge of the first surface to a panel center of the first surface. The second source IC may sequentially latch second image data, which is to be applied to the second surface, in a second direction DIR2 from a panel edge of the second surface to a panel center of the second surface. Here, the first direction DIR1 may be opposite to the second direction DIR2.

An output delay amount of the first source IC may increase in the first direction DIR1, and an output delay amount of the second source IC may increase in the second direction DIR2. An output delay of a source IC may be associated with an RC delay of a scan signal. An RC delay amount of the same scan signal in the first surface may increase in the first direction DIR1, and an RC delay amount of the same scan signal in the second surface may increase in the second direction DIR2.

In the first source IC, the first latch operation and the second latch operation may be performed in the first direction DIR1 with a certain time difference therebetween, and thus, a latch collision with respect to the same channel may be prevented. That is, based on the first latch control signal LbR having a high logic value H, the first latch operation may be sequentially performed on first image data in the first direction DIR1, and then, the second latch operation may start with a certain time difference with respect to a start timing of the first latch operation. Based on the second latch control signal DLYLR having a high logic value H, the second latch operation may be sequentially performed on the first image data in the first direction DIR1.

In the second source IC, the first latch operation and the second latch operation may be performed in the second direction DIR2 with a certain time difference therebetween, and thus, a latch collision with respect to the same channel may be prevented. That is, based on the first latch control signal LbR having a low logic value L, the first latch operation may be sequentially performed on second image data in the second direction DIR2, and then, the second latch operation may start with a certain time difference with respect to the start timing of the first latch operation. Based on the second latch control signal DLYLR having a low logic value L, the second latch operation may be sequentially performed on the second image data in the second direction DIR2.

Figure 7:
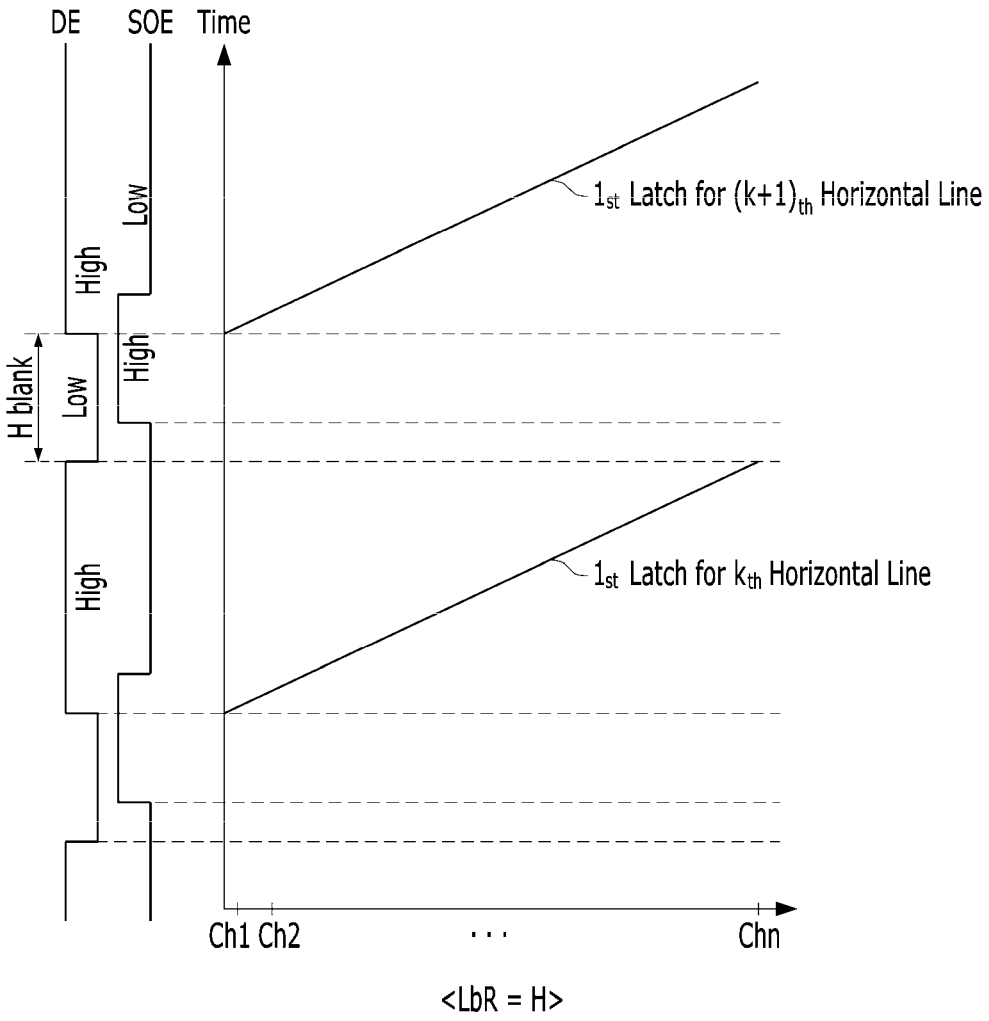
FIG. 7 is a diagram for describing a first latch operation on first image data which is to be applied to a first surface of a display panel.
Figure 8:
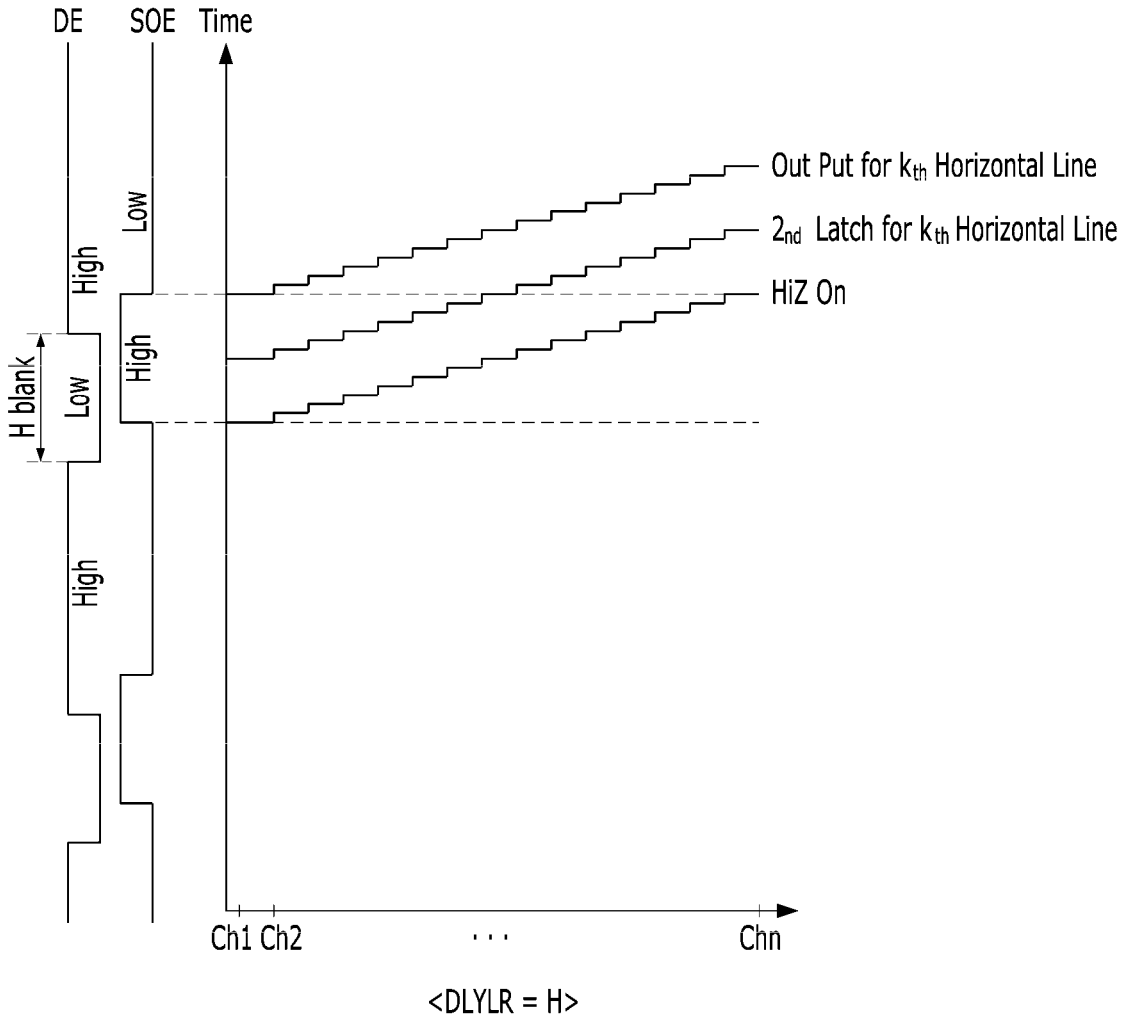
FIG. 8 is a diagram for describing a second latch operation and a first analog output operation on first image data which is to be applied to a first surface of a display panel.
Figure 9:
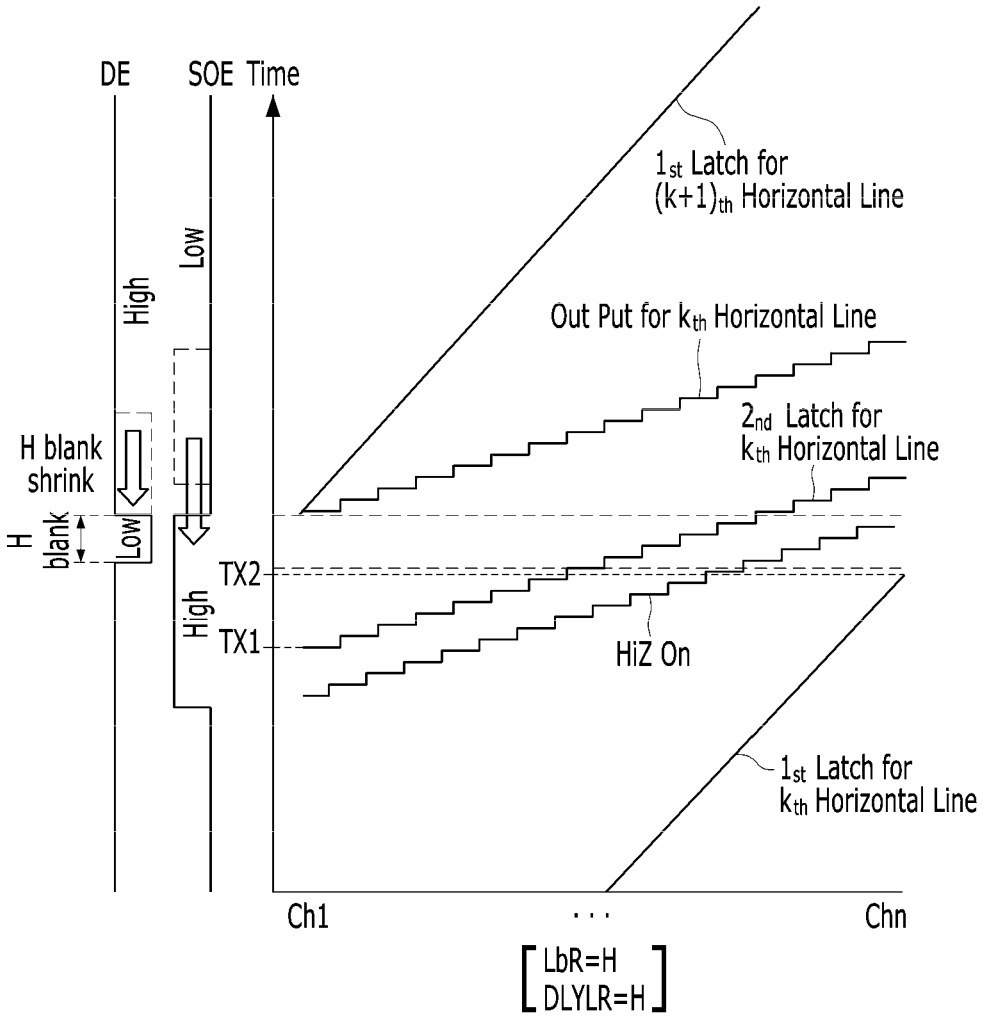
FIG. 9 is a diagram illustrating an example where a normal latch operation is performed without a latch collision despite a horizontal blank period being shortened, on a first surface of a display panel.

FIG. 7 is a diagram for describing a first latch operation on first image data which is to be applied to a first surface of a display panel. FIG. 8 is a diagram for describing a second latch operation and a first analog output operation on first image data which is to be applied to a first surface of a display panel. FIG. 9 is a diagram illustrating an example where a normal latch operation is performed without a latch collision despite a horizontal blank period being shortened, on a first surface of a display panel.

Referring to FIGS. 7 and 8, a first source IC may sequentially store $k^{th}$ first image data, which is to be applied to a $k^{th}$ (where k is a natural number) horizontal line of a first surface, in a first data register in a first direction in a first high period of a data enable signal DE (a $k^{th}$ first latch operation). Subsequently, the first source IC may sequentially store $k+1^{th}$ first image data, which is to be applied to a $k+1^{th}$ horizontal line of the first surface, in the first data register in the first direction in a second high period, succeeding the first high period, of the data enable signal DE (a $k+1^{th}$ first latch operation).

Furthermore, the first source IC may sequentially output the $k^{th}$ first image data, stored in the first data register, to a first digital-to-analog converter in the first direction in a low period, arranged between the first high period and the second high period, of the data enable signal DE (a $k^{th}$ second latch operation).

As described above, the first latch operation and the second latch operation performed by the first source IC may be performed in the same first direction from a first channel Ch1 to an $n^{th}$ channel Chn, and in this case, because the first latch operation and the second latch operation are performed on first image data, which is to be applied to the same horizontal line, with a certain time difference therebetween, a normal latch operation may be performed without a latch collision.

Moreover, as in FIG. 9, even when a horizontal blank period H blank is shortened, because a first latch timing and a second latch timing on the first image data to be applied to the same horizontal line overlap with each other with respect to the same horizontal line, a normal latch operation may be performed. The horizontal blank period H blank may be a low period of the data enable signal DE. When the horizontal blank period H blank is shortened, the source output enable signal SOE may be adjusted as in FIG. 9. Here, a high period of the data enable signal DE may be a latch enable period, and a low period of the source output enable signal SOE may be an analog output enable period.

Referring to FIG. 9, at least a portion of a low period of the data enable signal DE may overlap a high period of the source output enable signal SOE. In this case, in a low period of the source output enable signal SOE succeeding a high period of the source output enable signal SOE, a first analog output (for example, a first analog output of the $k^{th}$ first image data) of a first digital-to-analog converter may be sequentially performed in the first direction.

Referring to FIG. 9, the first source IC may further perform a $k^{th}$ second latch operation in some portions TX1 to TX2 of a first high period of the data enable signal DE close to a low period of the data enable signal DE and a portion of a second high period of the data enable signal DE close to the low period. That is, the first source IC may sequentially and further output the $k^{th}$ first image data, stored in the first data register, to the first digital-to-analog converter in the first direction in a portion of each of the first and second high periods.

In this case, in the some portions TX1 to TX2 of the first high period, the first latch operation of sequentially storing the $k^{th}$ first image data in the first data register and the second latch operation of sequentially outputting the $k^{th}$ first image data to the first digital-to-analog converter may be simultaneously performed without a collision. Also, in the portion of the second high period, the first latch operation of sequentially storing the $k+1^{th}$ first image data in the first data register and the second latch operation of sequentially outputting the $k^{th}$ first image data to the first digital-to-analog converter may be simultaneously performed without a collision.

Referring to FIGS. 7 to 9, when the abscissa axis represents a panel position in the first direction and the ordinate axis represents a time, a first graph connecting timings of the first latch operation at panel positions and a second graph connecting timings of the second latch operation at panel positions may rise right and upward over time. This may be because the first latch operation and the second latch operation are performed in the same first direction. In this case, because a high period of the source output enable signal SOE is shorter than a high period of the data enable signal DE, a slope of the first graph may differ from that of the second graph. This may be because a slope of the second graph is determined based on a slope of a "HiZ On" operation at each panel position performed during a high period of the source output enable signal SOE. The "HiZ On" operation may be sequentially performed in the first direction and may float a corresponding channel prior to the second latch operation.

Figure 10:
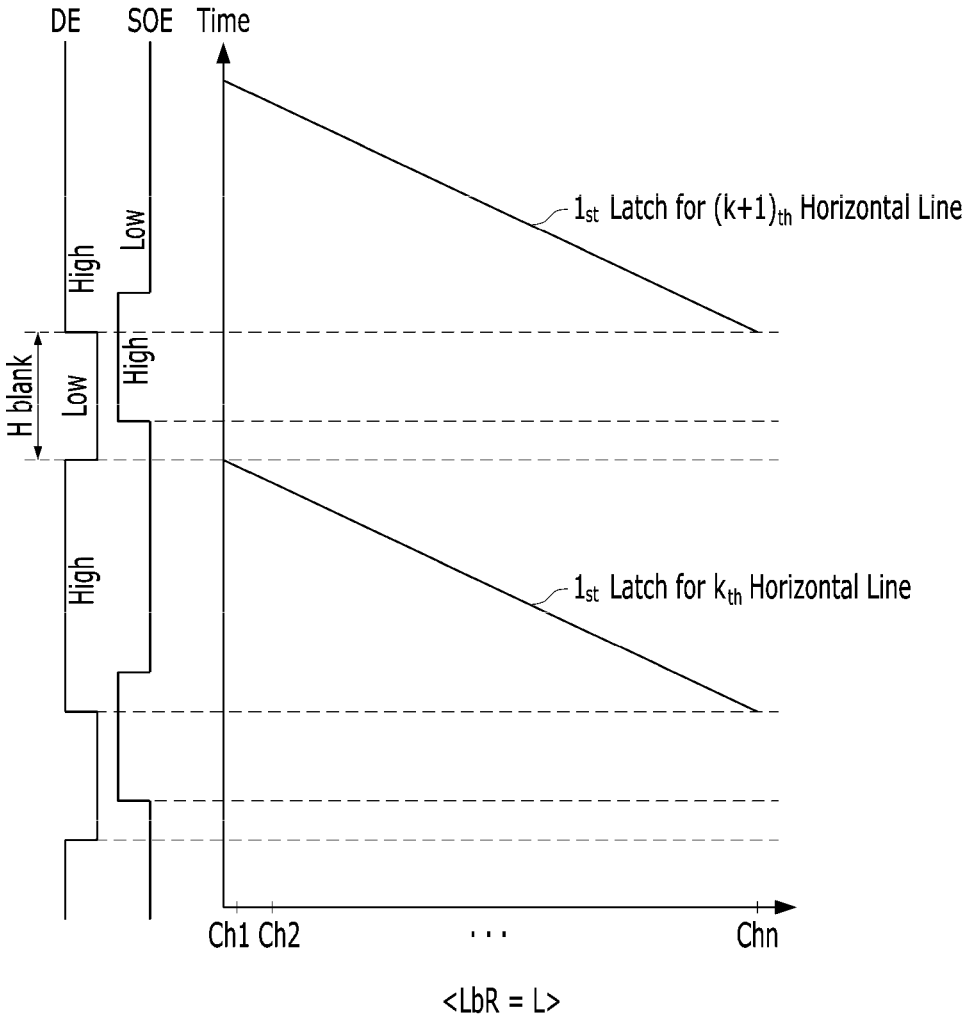
FIG. 10 is a diagram for describing a first latch operation on second image data which is to be applied to a second surface of a display panel.
Figure 11:
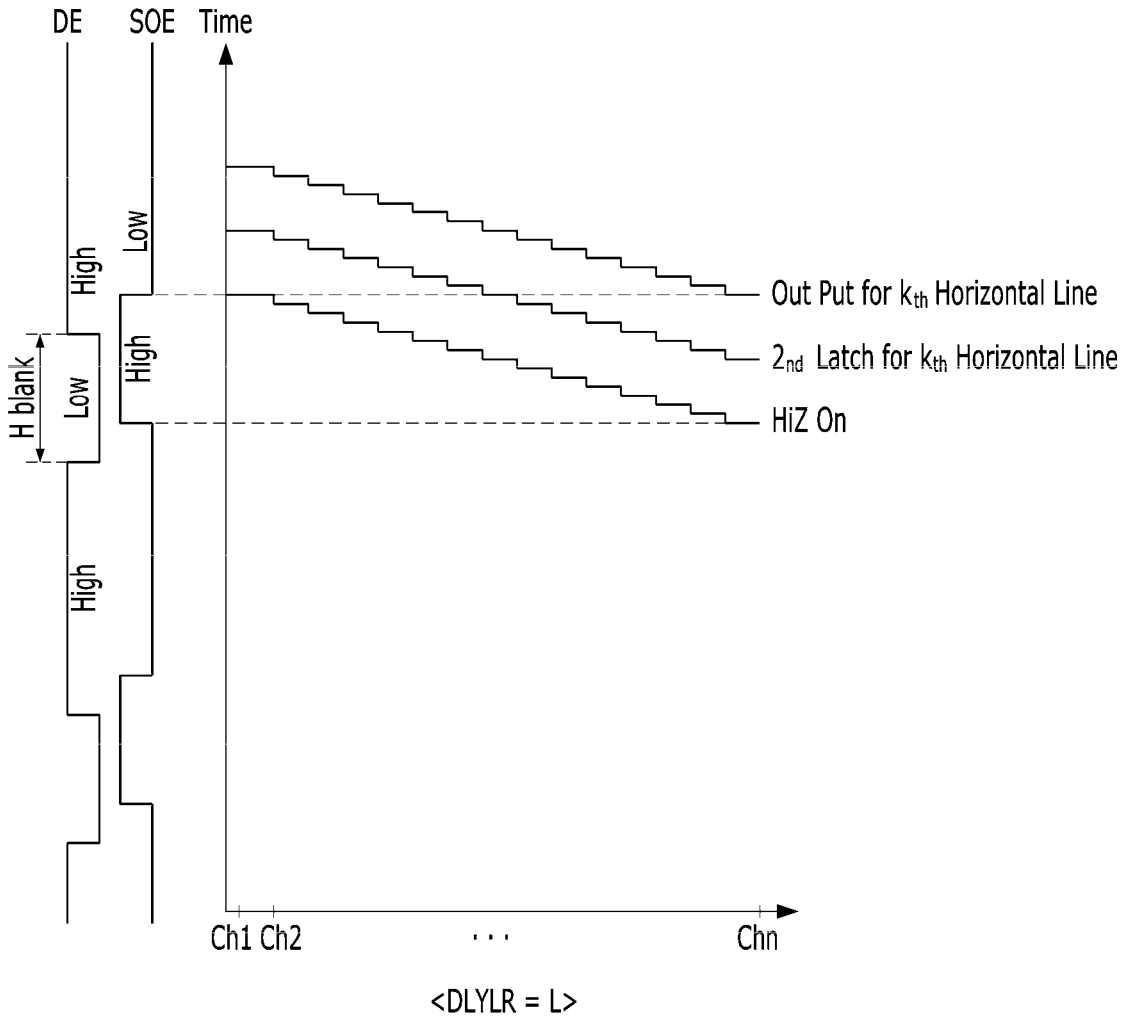
FIG. 11 is a diagram for describing a second latch operation and a second analog output operation on second image data which is to be applied to a second surface of a display panel.
Figure 12:
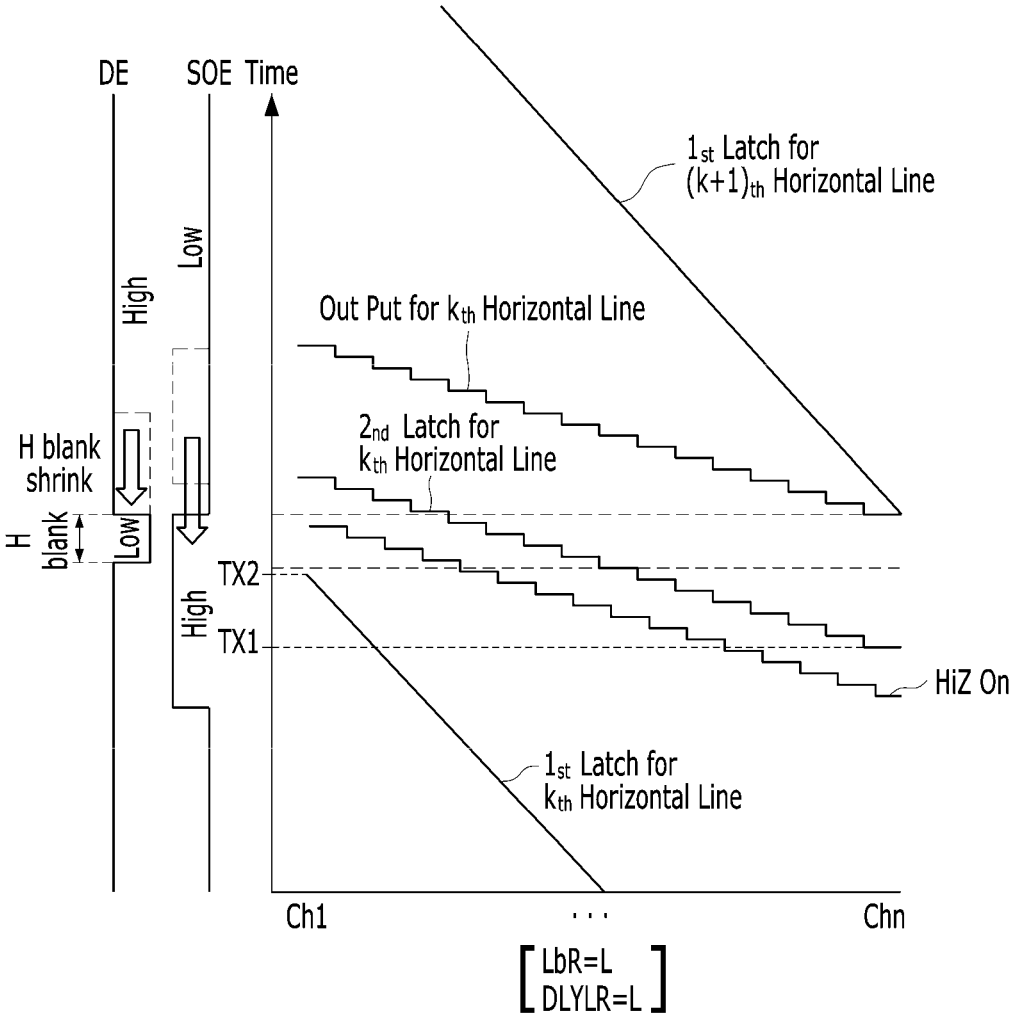
FIG. 12 is a diagram illustrating an example where a normal latch operation is performed without a latch collision despite a horizontal blank period being shortened, on a second surface of a display panel.

FIG. 10 is a diagram for describing a first latch operation on second image data which is to be applied to a second surface of a display panel. FIG. 11 is a diagram for describing a second latch operation and a second analog output operation on second image data which is to be applied to a second surface of a display panel. FIG. 12 is a diagram illustrating an example where a normal latch operation is performed without a latch collision despite a horizontal blank period being shortened, on a second surface of a display panel.

Referring to FIGS. 10 and 11, a second source IC may sequentially store $k^{th}$ second image data, which is to be applied to a $k^{th}$ (where k is a natural number) horizontal line of a second surface, in a second data register in a second direction in a first high period of a data enable signal DE (a $k^{th}$ first latch operation). Subsequently, the second source IC may sequentially store $k+1^{th}$ second image data, which is to be applied to a $k+1^{th}$ horizontal line of the second surface, in the second data register in the second direction in a second high period, succeeding the first high period, of the data enable signal DE (a $k+1^{th}$ first latch operation).

Furthermore, the second source IC may sequentially output the $k^{th}$ second image data, stored in the second data register, to a second digital-to-analog converter in the second direction in a low period, arranged between the first high period and the second high period, of the data enable signal DE (a $k^{th}$ second latch operation).

As described above, the first latch operation and the second latch operation performed by the second source IC may be performed in the same second direction from a first channel Ch1 to an $n^{th}$ channel Chn, and in this case, because the first latch operation and the second latch operation are performed on second image data, which is to be applied to the same horizontal line, with a certain time difference therebetween, a normal latch operation may be performed without a latch collision.

Moreover, as in FIG. 12, even when a horizontal blank period H blank is shortened, because a first latch timing and a second latch timing on the second image data to be applied to the same horizontal line overlap with each other with respect to the same horizontal line, a normal latch operation may be performed. The horizontal blank period H blank may be a low period of the data enable signal DE. When the horizontal blank period H blank is shortened, the source output enable signal SOE may be adjusted as in FIG. 12. Here, a high period of the data enable signal DE may be a latch enable period, and a low period of the source output enable signal SOE may be an analog output enable period.

Referring to FIG. 12, at least a portion of a low period of the data enable signal DE may overlap a high period of the source output enable signal SOE. In this case, in a low period of the source output enable signal SOE succeeding a high period of the source output enable signal SOE, a second analog output (for example, a second analog output of the $k^{th}$ second image data) of a second digital-to-analog converter may be sequentially performed in the second direction.

Referring to FIG. 12, the second source IC may further perform a $k^{th}$ second latch operation in some portions TX1 to TX2 of a first high period of the data enable signal DE close to a low period of the data enable signal DE and a portion of a second high period of the data enable signal DE close to the low period. That is, the second source IC may sequentially and further output the $k^{th}$ second image data, stored in the second data register, to the second digital-to-analog converter in the second direction in a portion of each of the first and second high periods.

In this case, in the some portions TX1 to TX2 of the first high period, the first latch operation of sequentially storing the $k^{th}$ second image data in the second data register and the second latch operation of sequentially outputting the $k^{th}$ second image data to the second digital-to-analog converter may be simultaneously performed without a collision. Also, in the portion of the second high period, the first latch operation of sequentially storing the $k+1^{th}$ second image data in the second data register and the second latch operation of sequentially outputting the $k^{th}$ second image data to the second digital-to-analog converter may be simultaneously performed without a collision.

Referring to FIGS. 10 to 12, when the abscissa axis represents a panel position in the second direction and the ordinate axis represents a time, a first graph connecting timings of the first latch operation at panel positions and a second graph connecting timings of the second latch operation at panel positions may rise left and upward over time. This may be because the first latch operation and the second latch operation are performed in the same second direction. In this case, because a high period of the source output enable signal SOE is shorter than a high period of the data enable signal DE, a slope of the first graph may differ from that of the second graph. This may be because a slope of the second graph is determined based on a slope of a "HiZ On" operation at each panel position performed during a high period of the source output enable signal SOE. The "HiZ On" operation may be sequentially performed in the second direction and may float a corresponding channel prior to the second latch operation.

Figure 13A:
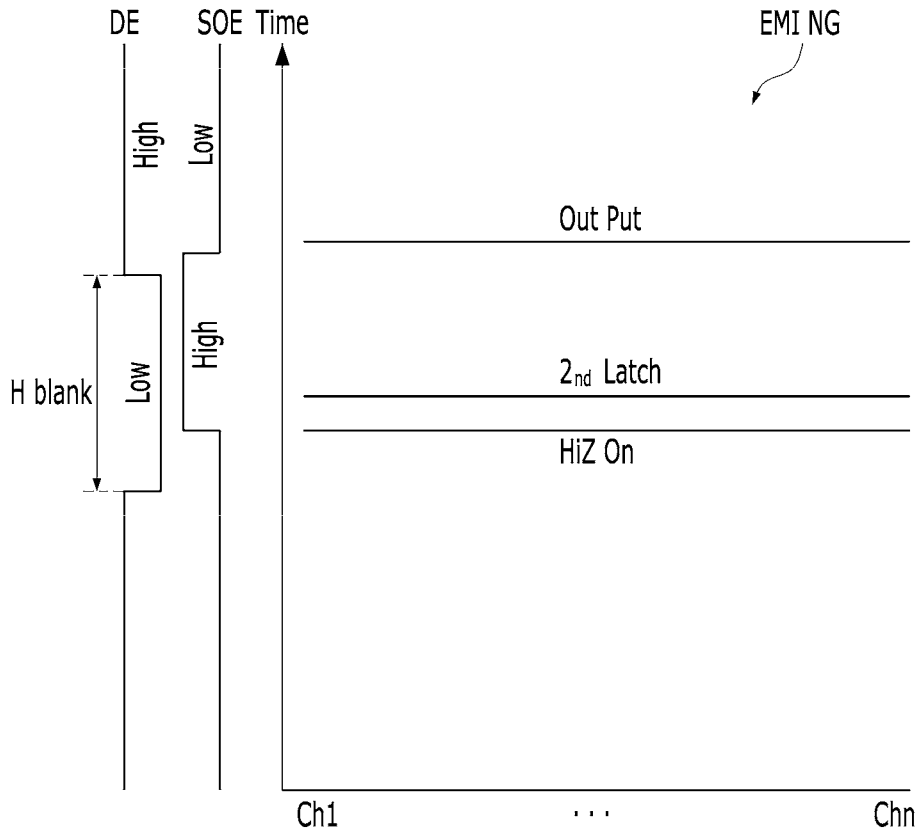
FIG. 13A is a diagram illustrating an example where each of a second latch operation and an analog output operation is simultaneously performed on a plurality of channels.
Figure 13B:
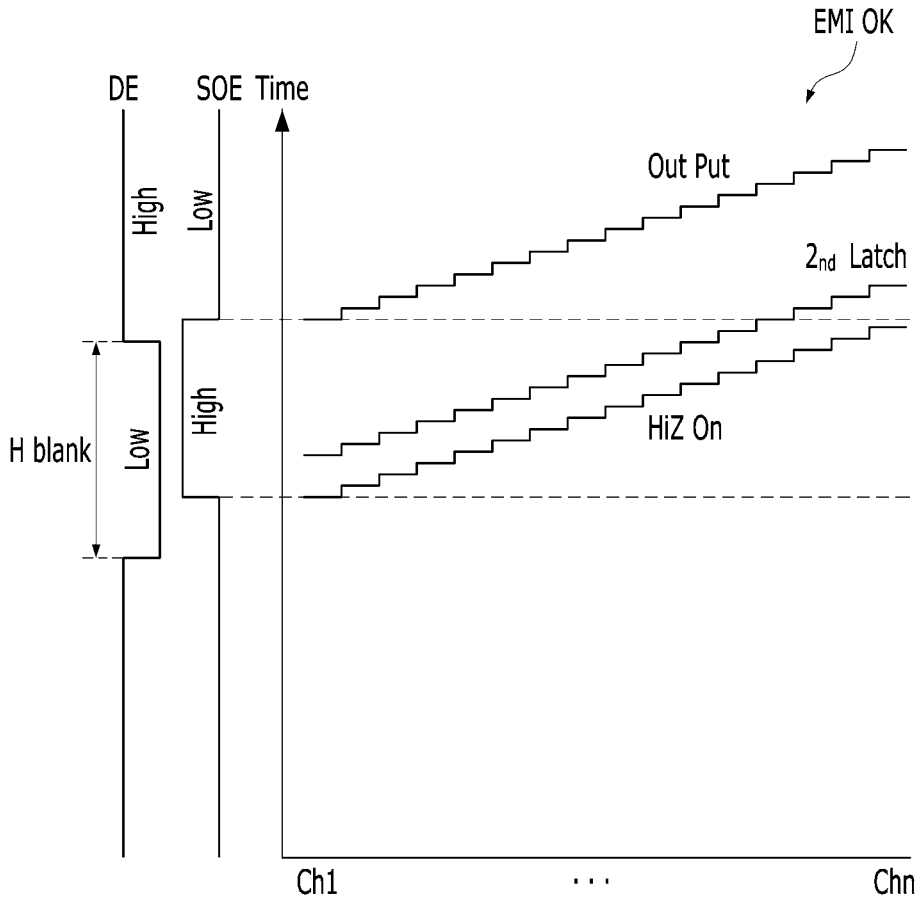
FIG. 13B is a diagram illustrating an example where each of a second latch operation and an analog output operation is sequentially performed on a plurality of channels.

FIG. 13A is a diagram illustrating an example where each of a second latch operation and an analog output operation is simultaneously performed on a plurality of channels. FIG. 13B is a diagram illustrating an example where each of a second latch operation and an analog output operation is sequentially performed on a plurality of channels.

Referring to FIG. 13A, a second latch operation and an analog output operation described above may be simultaneously performed based on a plurality of channels with a certain time difference therebetween. In this case, EMI peak noise may increase.

On the other hand, in embodiments of the present disclosure, a time split scheme of FIG. 13B may be applied for decreasing EMI peak noise.

Referring to FIG. 13B, a second latch operation and an analog output operation described above may be sequentially performed based on a plurality of channels with a certain time difference therebetween. The second latch operation may be sequentially performed based on the plurality of channels with a time interval of about tens nsec to about hundreds nsec. Also, the analog output operation may be sequentially performed based on the plurality of channels with a time interval of about tens nsec to about hundreds nsec. Accordingly, EMI peak noise may be considerably reduced.

Figure 14:
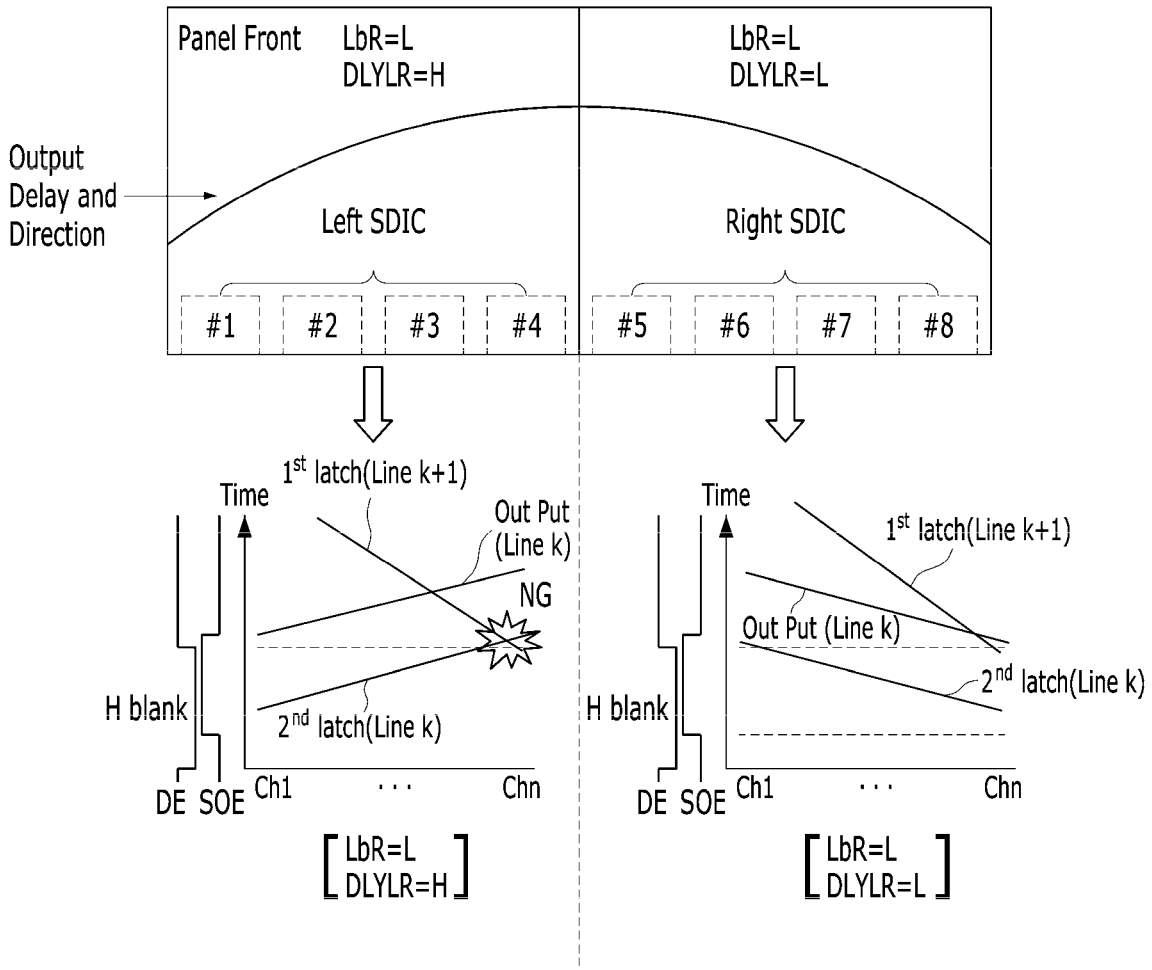
FIGS. 14 and 15 are diagrams illustrating a latch collision (or latch error) operation occurring when a horizontal blank period is shortened, in a comparative example of the present embodiment.
Figure 15:
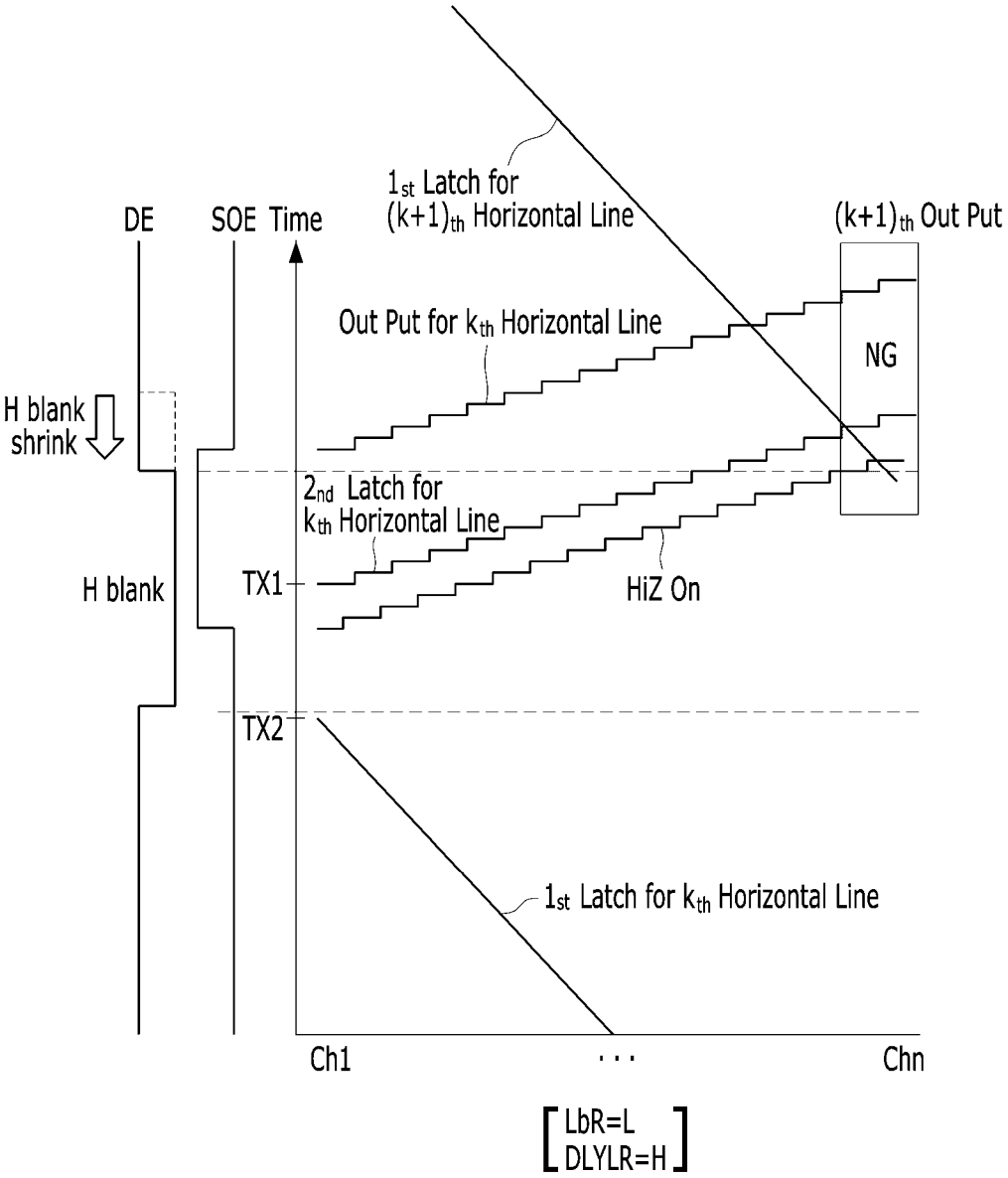

FIGS. 14 and 15 are diagrams illustrating a latch collision (or latch error) operation occurring when a horizontal blank period is shortened, in a comparative example of the present embodiment.

In a comparative example of FIGS. 14 and 15, a first latch control signal LbR for driving a first surface of a display panel and a first latch control signal LbR for driving a second surface of the display panel may all be set to a low logic value L, a second latch control signal DLYLR for driving the first surface of the display panel may be set to a high logic value H, and a second latch control signal DLYLR for driving the second surface of the display panel may be set to a low logic value L.

Based on the first latch control signal LbR having a low logic value L, a first latch operation on first image data of the first surface and a first latch operation on second image data of the second surface may all be sequentially performed in a second direction (a direction from Chn to Ch1), and thus, a first graph connecting timings of the first latch operation at panel positions may rise left and upward in the first surface and the second surface.

Based on the second latch control signal DLYLR having a high logic value H, a second latch operation on the first image data of the first surface may be sequentially performed in a first direction (a direction from Ch1 to Chn), and thus, a second graph connecting timings of the second latch operation at panel positions may rise right and upward in the first surface. On the other hand, based on the second latch control signal DLYLR having a low logic value L, a second latch operation on second image data of the second surface may be sequentially performed in the second direction, and thus, a second graph connecting timings of the second latch operation at panel positions may rise left and upward in the second surface.

To provide a summary description, the first graph and the second graph may have slopes in opposite directions in the first surface and may have a slope in the same direction in the second surface.

When a horizontal blank period H blank which is a low period of the data enable signal DE is long, a bandwidth of data transferred between a timing controller and a source IC may increase. This may be because image data is transferred in a high period of the data enable signal DE.

In order to decrease a bandwidth of transferred data, the horizontal blank period H blank should be shortened. However, when the horizontal blank period H blank is shortened, because the first graph overlaps with the second graph in the first surface, a latch collision may occur. The latch collision may occur because a first latch timing of $k+1^{th}$ first image data is prior to a second latch timing of $k^{th}$ first image data with respect to the same channel. When the latch collision occurs, the $k+1^{th}$ first image data may be abnormally output instead of the $k^{th}$ first image data.

As a result, in the comparative example of FIGS. 14 and 15, because the first graph and the second graph have slopes in opposite directions in the first surface, it may be difficult to shorten the horizontal blank period H blank.

Figure 16:
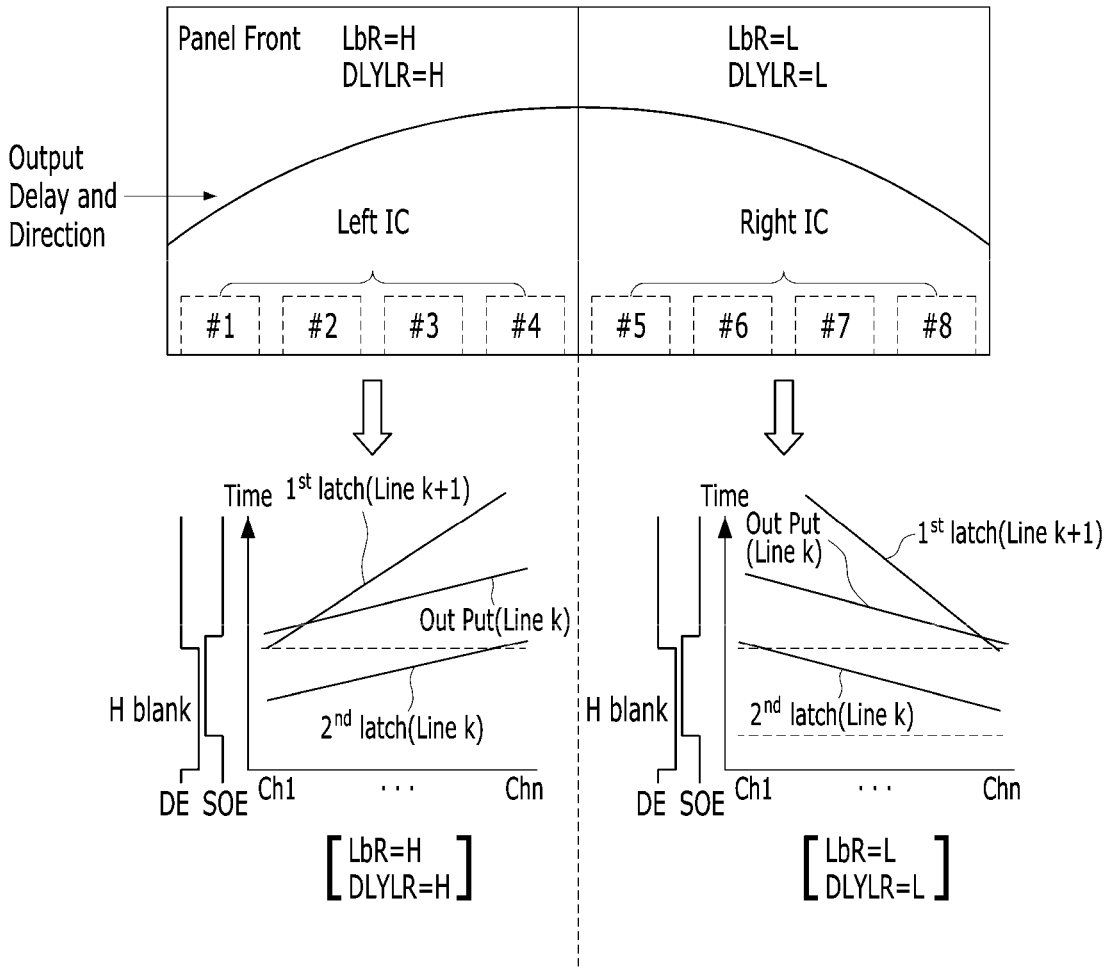
FIG. 16 is a diagram illustrating an example where a first latch operation and a second latch operation according to the present embodiment are performed in the same direction on each of a first surface and a second surface.

FIG. 16 is a diagram illustrating an example where a first latch operation and a second latch operation according to the present embodiment are performed in the same direction on each of a first surface and a second surface.

Referring to FIG. 16, a first latch operation and a second latch operation may be performed in the same direction in a first surface and a second surface of a display panel. Accordingly, in some embodiments, a first latch control signal LbR and a second latch control signal DLYLR for driving the first surface of the display panel may all be set to a high logic value H, and a first latch control signal LbR and a second latch control signal DLYLR for driving the second surface of the display panel may all be set to a low logic value L.

Based on the first latch control signal LbR having a low logic value L, a first latch operation on first image data of the first surface may be sequentially performed in a first direction (a direction from Ch1 to Chn), and thus, a first graph connecting timings of the first latch operation at panel positions may rise right and upward. Also, based on the second latch control signal DLYLR having a low logic value L, a second latch operation on the first image data of the first surface may be sequentially performed in the first direction, and thus, a second graph connecting timings of the second latch operation at panel positions may also rise right and upward in the second surface.

On the other hand, based on the first latch control signal LbR having a low logic value L, a first latch operation on second image data of the second surface may be sequentially performed in a second direction (a direction from Chn to Ch1), and thus, a first graph connecting timings of the first latch operation at panel positions may rise left and upward. Also, based on the second latch control signal DLYLR having a low logic value L, a second latch operation on the second image data of the second surface may be sequentially performed in the second direction, and thus, a second graph connecting timings of the second latch operation at panel positions may also rise left and upward in the second surface.

To provide a summary description, the first graph and the second graph may have a slope in the same direction in the first surface and may have a slope in the same direction in the second surface.

In the present embodiment, even when the horizontal blank period H blank is shortened, the first graph may not overlap with the second graph in the first surface, and moreover, the first graph may not overlap with the second graph in the second surface. Accordingly, a latch collision occurring in the comparative example described above may not occur in the present embodiment.

Figure 17:
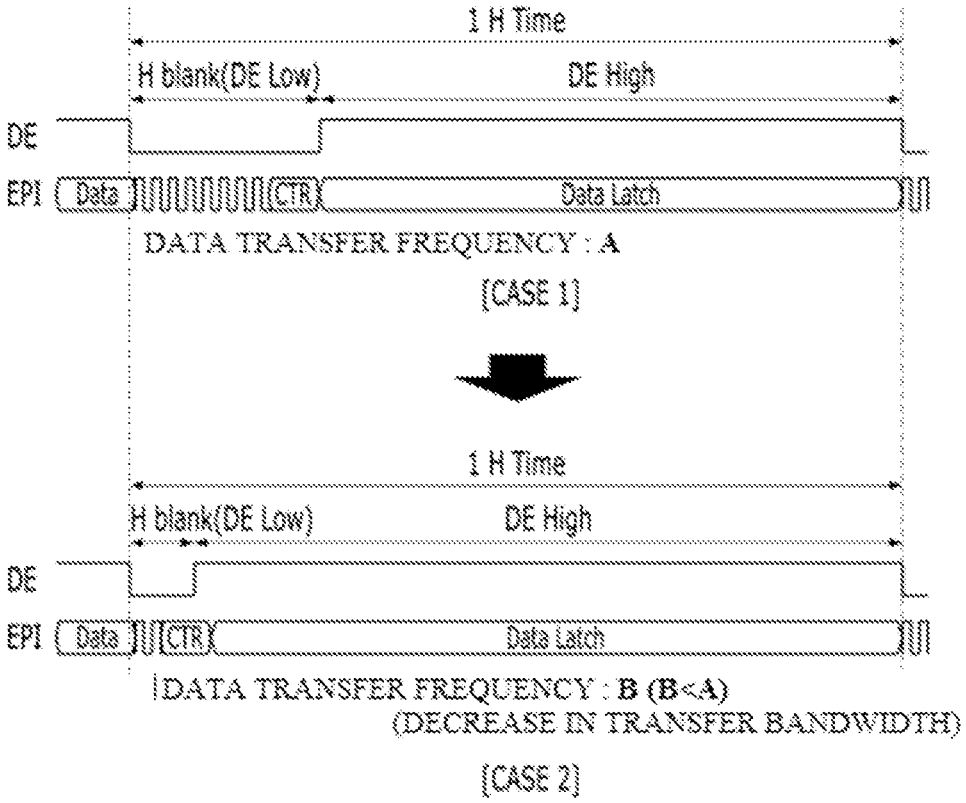
FIG. 17 is a diagram illustrating an example where a transfer frequency and a bandwidth are reduced as a high period of a data enable signal increases, when a horizontal blank period is shortened.

FIG. 17 is a diagram illustrating an example where a transfer frequency and a bandwidth are reduced as a high period of a data enable signal increases, when a horizontal blank period is shortened.

Referring to FIG. 17, the present embodiment may apply a case 2 for reducing a bandwidth of transferred data. In the present embodiment, the horizontal blank period H blank may be shorter than a case 1. As described above, even when the case 2 is applied, the present embodiment may prevent a latch error.

In the present embodiment, even when the amount of data transferred between a timing controller and a source IC increases, a bandwidth of transferred data may decrease without a latch error, and thus, EMI and power consumption may be reduced or minimized.

The present embodiment may realize the following effects.

In the present embodiment, a sequential performance direction of a first latch operation performed on image data may match a sequential performance direction of a second latch operation performed on the image data, with respect to a plurality of channels. Here, with respect to the same channel, the first latch operation may be earlier by a certain time difference than the second latch operation. Therefore, even when a horizontal blank period is shortened, a first latch timing and a second latch timing of first image data to be applied to the same horizontal line may not overlap with respect to the same channel, and thus, a normal latch operation may be performed without a latch error. When the horizontal blank period is shortened, a bandwidth of data transferred between a timing controller and a source IC may be reduced. As a result, in the present embodiment, even when the amount of data transferred between the timing controller and the source IC increases, a bandwidth of transferred data may decrease without a latch error, and thus, EMI and power consumption may be reduced or minimized.

Furthermore, in the present embodiment, a sequential performance direction of a first latch operation and a sequential performance direction of a second latch operation performed on image data may match a direction in which an output delay amount of the source IC increases, and thus, a data charging deviation at each panel position may be reduced or minimized.

Moreover, in the present embodiment, with respect to a plurality of channels, a second latch operation may be sequentially performed based on a time split scheme, and thus, EMI peak noise may decrease.

The effects according to the present disclosure are not limited to the above examples, and other various effects may be included in the specification.

While the present disclosure has been particularly shown and described with reference to example embodiments thereof, it will be understood by those of ordinary skill in the art that various changes in form and details may be made therein without departing from the spirit and scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display apparatus comprising:

a display panel having a first surface including first pixels and a second surface including second pixels, the first surface being in contact with the second surface at a panel center thereof;

a first source integrated circuit (IC) sequentially latching first image data, which is to be applied to the first surface, in a first direction facing the panel center at a left panel edge of the first surface; and a second source IC sequentially latching second image data, which is to be applied to the second surface, in a second direction facing the panel center at a right panel edge of the second surface, wherein the first direction is opposite to the second direction, and wherein the first source IC sequentially stores $k^{th}$ first image data, which is to be applied to a $k^{th}$ horizontal line of the first surface, in a first data register in the first direction in a first high period of a data enable signal, sequentially stores $k+1^{th}$ first image data, which is to be applied to a $k+1^{th}$ horizontal line of the first surface, in the first data register in the first direction in a second high period, succeeding the first high period, of the data enable signal, and sequentially outputs the $k^{th}$ first image data, stored in the first data register, to a first digital-to-analog converter in the first direction in a low period, arranged between the first high period and the second high period, of the data enable signal, where k is a natural number.

2. The display apparatus of claim 1, wherein a latch operation of the first source IC performed on the first image data includes a first latch operation and a second latch operation performed sequentially in the first direction, and a latch operation of the second source IC performed on the second image data includes a first latch operation and a second latch operation performed sequentially in the second direction.

3. The display apparatus of claim 1, wherein an output delay amount of the first source IC increases in the first direction, and an output delay amount of the second source IC increases in the second direction.

4. The display apparatus of claim 1, wherein at least a portion of a low period of the data enable signal overlaps a high period of a source output enable signal, in the low period of the source output enable signal succeeding the high period of the source output enable signal, a first analog output of the first digital-to-analog converter is sequentially performed in the first direction, and in the low period of the source output enable signal, a second analog output of a second digital-to-analog converter is sequentially performed in the second direction.

5. The display apparatus of claim 4, wherein the low period of the data enable signal is shorter than the high period of the source output enable signal.

6. The display apparatus of claim 1, wherein the first source IC sequentially and further outputs the $k^{th}$ first image data, stored in the first data register, to the first digital-to-analog converter in the first direction in a portion of the first high period close to the low period and a portion of the second high period close to the low period.

7. The display apparatus of claim 6, wherein a first latch operation of sequentially storing the $k^{th}$ first image data in the first data register and a second latch operation of sequentially outputting the $k^{th}$ first image data to the first digital-to-analog converter are simultaneously performed in a portion of the first high period.

8. The display apparatus of claim 7, wherein, when an abscissa axis represents a panel position in the first direction and an ordinate axis represents a time, a first graph connecting timings of the first latch operation at panel positions and a second graph connecting timings of the second latch operation at panel positions rise right and upward over time.

9. The display apparatus of claim 8, wherein a slope of the first graph differs from a slope of the second graph.

10. The display apparatus of claim 6, wherein a first latch operation of sequentially storing the $k+1^{th}$ first image data in the first data register and a second latch operation of sequentially outputting the $k^{th}$ first image data to the first digital-to-analog converter are simultaneously performed in a portion of the second high period.

11. The display apparatus of claim 10, wherein, when an abscissa axis represents a panel position in the first direction and an ordinate axis represents a time, a first graph connecting timings of the first latch operation at panel positions and a second graph connecting timings of the second latch operation at panel positions rise right and upward over time.

12. The display apparatus of claim 11, wherein a slope of the first graph differs from a slope of the second graph.

13. The display apparatus of claim 1, wherein the second source IC sequentially stores $k^{th}$ second image data, which is to be applied to a $k^{th}$ horizontal line of the second surface, in a second data register in the second direction in the first high period of the data enable signal, sequentially stores $k+1^{th}$ second image data, which is to be applied to a $k+1^{th}$ horizontal line of the second surface, in the second data register in the second direction in the second high period of the data enable signal, and sequentially outputs the $k^{th}$ second image data, stored in the second data register, to a second digital-to-analog converter in the second direction in a low period, arranged between the first high period and the second high period, of the data enable signal, where k is a natural number.

14. The display apparatus of claim 13, wherein the second source IC sequentially and further outputs the $k^{th}$ second image data, stored in the second data register, to the second digital-to-analog converter in the second direction in a portion of the first high period close to the low period and a portion of the second high period close to the low period.

15. The display apparatus of claim 14, wherein a first latch operation of sequentially storing the $k^{th}$ second image data in the second data register and a second latch operation of sequentially outputting the $k^{th}$ second image data to the second digital-to-analog converter are simultaneously performed in a portion of the first high period.

16. The display apparatus of claim 15, wherein, when an abscissa axis represents a panel position in the first direction and an ordinate axis represents a time, a first graph connecting timings of the first latch operation at panel positions and a second graph connecting timings of the second latch operation at panel positions rise left and upward over time.

17. The display apparatus of claim 16, wherein a slope of the first graph differs from a slope of the second graph.

18. The display apparatus of claim 14, wherein a first latch operation of sequentially storing the $k+1^{th}$ second image data in the second data register and a second latch operation of sequentially outputting the $k^{th}$ second image data to the second digital-to-analog converter are simultaneously performed in a portion of the second high period.

19. The display apparatus of claim 18, wherein, when an abscissa axis represents a panel position in the first direction and an ordinate axis represents a time, a first graph connecting timings of the first latch operation at panel positions and a second graph connecting timings of the second latch operation at panel positions rise left and upward over time.

20. The display apparatus of claim 19, wherein a slope of the first graph differs from a slope of the second graph.

21. The display apparatus of claim 13, wherein at least a portion of a low period of the data enable signal overlaps a high period of a source output enable signal, in the low period of the source output enable signal succeeding the high period of the source output enable signal, a first analog output of a first digital-to-analog converter is sequentially performed in the first direction, and in the low period of the source output enable signal, a second analog output of a second digital-to-analog converter is sequentially performed in the second direction.

22. The display apparatus of claim 21, wherein the low period of the data enable signal is shorter than the high period of the source output enable signal.

23. A display apparatus comprising:

a display panel having a first surface and a second surface divided by an imaginary center line along a center of the display panel;

first pixels disposed below the first surface of the display panel;

second pixels disposed below the second surface of the display panel;

a first source integrated circuit (IC) sequentially latch first image data, which is to be applied to the first surface, in a first direction facing the imaginary center line at a left panel edge of the first surface;

a second source IC sequentially latching second image data, which is to be applied to the second surface, in a second direction facing the imaginary center line at a right panel edge of the second surface;

a first data register; and a first digital-to-analog converter, wherein the first direction is opposite to the second direction, wherein the first image data includes a k number of first image data, where k is a natural number, and wherein the first source IC is configured to:

sequentially store kth first image data, which is to be applied to a kth horizontal line of the first surface, in the first data register in the first direction in a first high period of a data enable signal, sequentially store k+1th first image data, which is to be applied to a k+1th horizontal line of the first surface, in the first data register in the first direction in a second high period, succeeding the first high period, of the data enable signal, and sequentially output the kth first image data, stored in the first data register, to the first digital-to-analog converter in the first direction in a low period, arranged between the first high period and the second high period, of the data enable signal.

24. The display apparatus of claim 23, further comprising:

a second digital-to-analog converter, wherein at least a portion of a low period of the data enable signal overlaps a high period of a source output enable signal, in the low period of the source output enable signal succeeding the high period of the source output enable signal, a first analog output of the first digital-to-analog converter is sequentially performed in the first direction, and in the low period of the source output enable signal, a second analog output of the second digital-to-analog converter is sequentially performed in the second direction, wherein the low period of the data enable signal is shorter than the high period of the source output enable signal.

25. The display apparatus of claim 23, further comprising:

a second data register; and a second digital-to-analog converter, wherein the second image data includes a k number of second image data, where k is a natural number, wherein the second source IC is configured to:

sequentially store kth second image data, which is to be applied to a kth horizontal line of the second surface, in the second data register in the second direction in the first high period of the data enable signal, sequentially store k+1th second image data, which is to be applied to a k+1th horizontal line of the second surface, in the second data register in the second direction in the second high period of the data enable signal, and sequentially output the kth second image data, stored in the second data register, to the second digital-to-analog converter in the second direction in a low period, arranged between the first high period and the second high period, of the data enable signal.

26. The display apparatus of claim 25, wherein the second source IC sequentially and further outputs the $k^{th}$ second image data, stored in the second data register, to the second digital-to-analog converter in the second direction in a portion of the first high period close to the low period and a portion of the second high period close to the low period.

27. The display apparatus of claim 26, wherein a first latch operation of sequentially storing the $k^{th}$ second image data in the second data register and a second latch operation of sequentially outputting the $k^{th}$ second image data to the second digital-to-analog converter are simultaneously performed in a portion of the first high period.

* * * * *